US006218601B1

(12) United States Patent
Pientka

(10) Patent No.: US 6,218,601 B1
(45) Date of Patent: Apr. 17, 2001

(54) IN-LINE KEYBOARD

(76) Inventor: Vincent F. Pientka, 1733 County Rd. M, Stevens Point, WI (US) 54481

( * ) Notice: Subject to any disclaimer, the term of this patent is extended or adjusted under 35 U.S.C. 154(b) by 0 days.

(21) Appl. No.: 09/439,270

(22) Filed: Nov. 12, 1999

(51) Int. Cl.[7] ..... G10C 3/12

(52) U.S. Cl. ..... 84/423 R; 84/439; 84/442; 84/443

(58) Field of Search ..... 84/600, 423 R, 84/439, 442, 443

(56) References Cited

U.S. PATENT DOCUMENTS 5,581,484 * 12/1996 Prince ..... 364/559
5,841,052 * 11/1998 Stanton ..... 84/600
5,907,115 * 5/1999 Matsunaga et al. ..... 84/477 R

* cited by examiner

*Primary Examiner*—Robert E. Nappi
*Assistant Examiner*—Kim Lockett
(74) *Attorney, Agent, or Firm*—Donald Cayen

(57) ABSTRACT

An in-line keyboard provides a large number of music producing actuators in a small space. Each actuator corresponds to a note on a musical scale. The actuators are arranged in perpendicular columns and rows. The actuators of each column are played by a single finger. The actuators corresponding to natural notes have a first tactile feel, such as cylindrical. Actuators corresponding to sharp and flat notes have a different tactile feel. The actuators corresponding to the sharp and flat notes are arranged in columns between the columns of the natural note actuators. The natural notes are further arranged such that pairs of adjacent actuators in a column correspond to perfect fifths of a musical scale.

17 Claims, 3 Drawing Sheets

FIG. 1
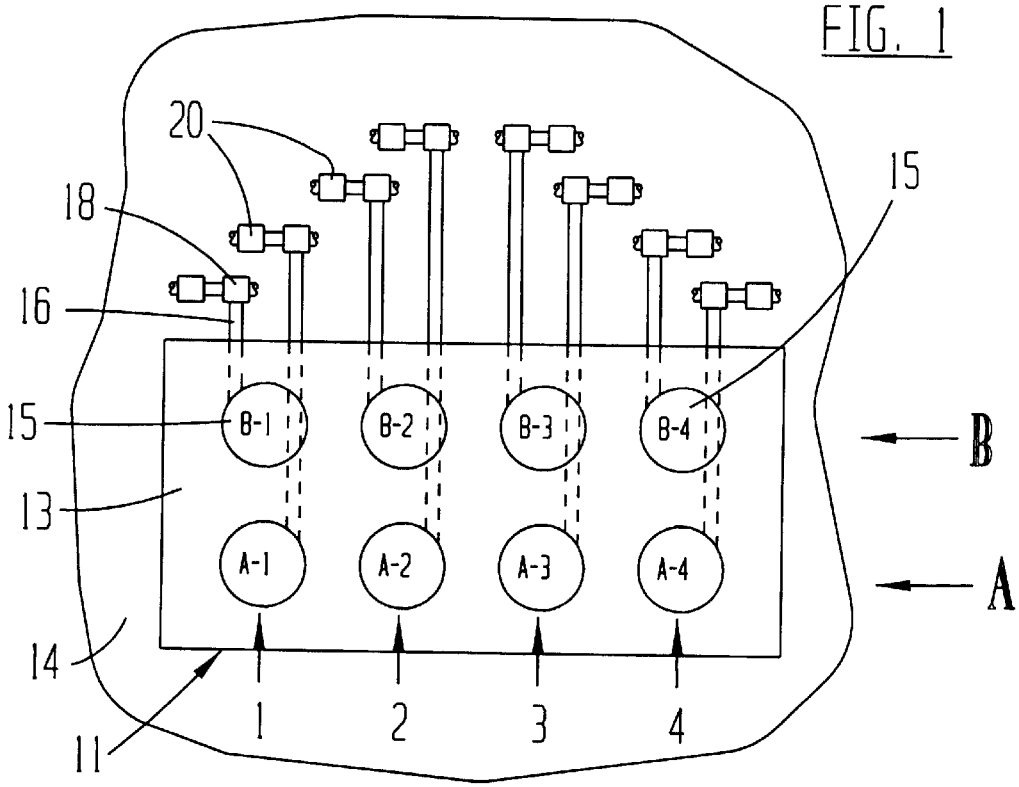
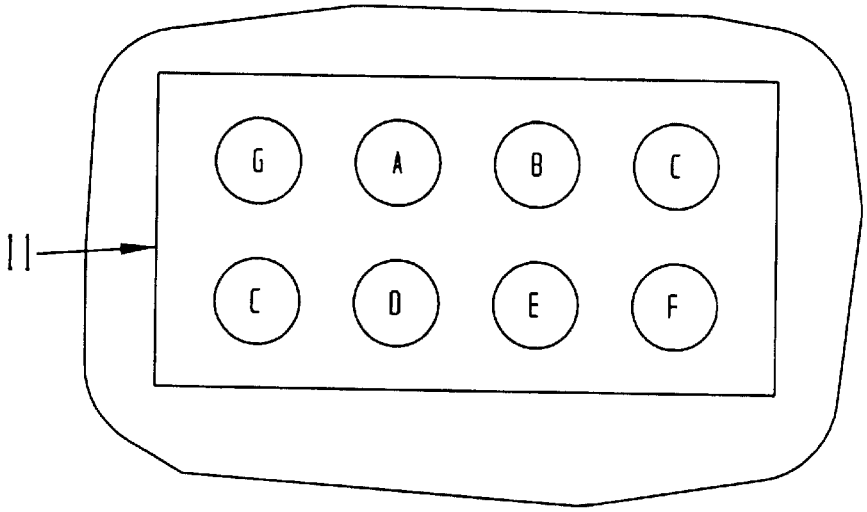
FIG. 1A

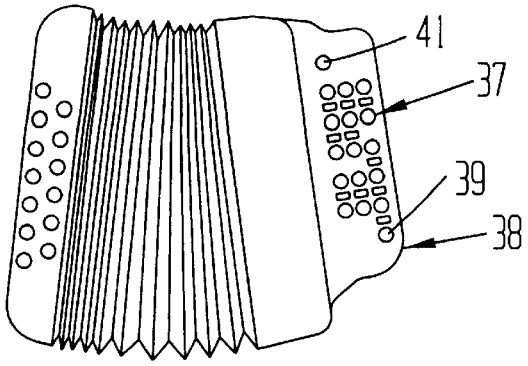
FIG. 8
FIG. 2
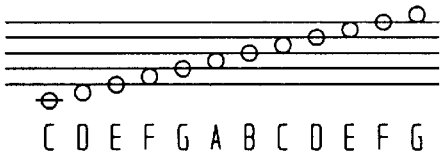
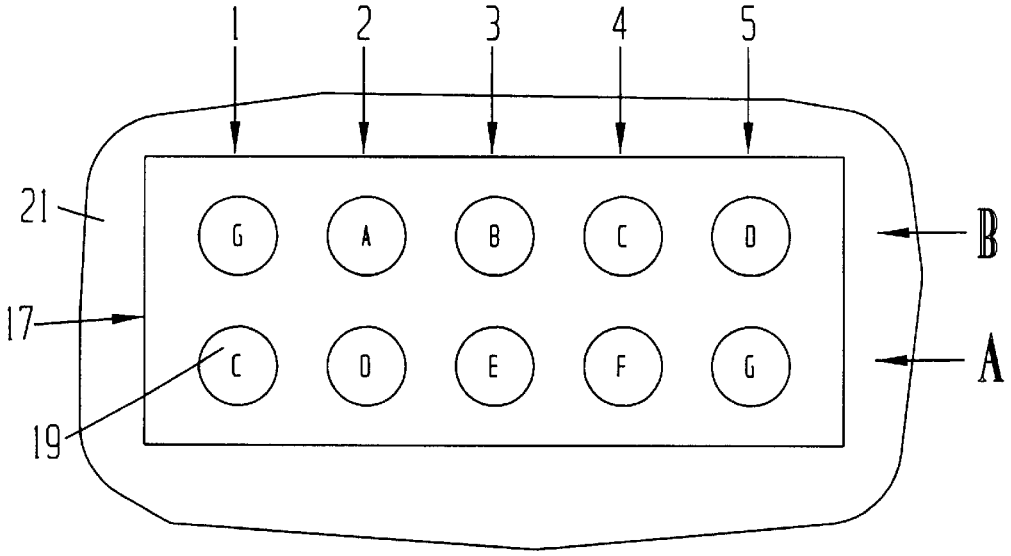
FIG. 3

FIG. 4
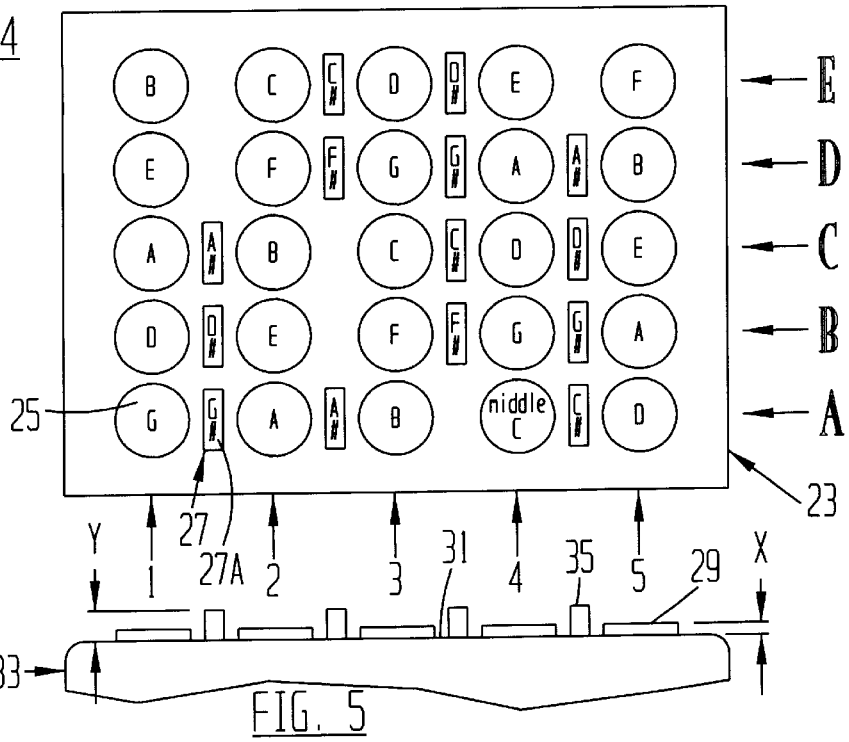
FIG. 5
FIG. 6
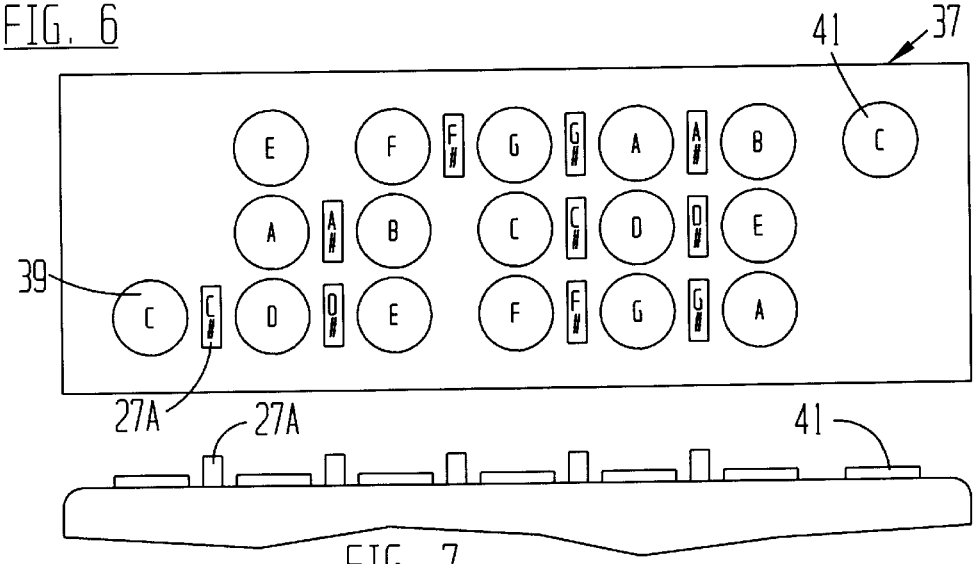
FIG. 7

IN-LINE KEYBOARD

BACKGROUND OF THE INVENTION

This invention pertains to musical instruments, and more particularly to instruments having multiple finger-operated actuators.

DESCRIPTION OF THE PRIOR ART

Numerous types of musical instruments are played by using the fingers. Manipulating the fingers a certain way causes the instruments to produce corresponding notes of a musical scale.

Many instruments utilize a keyboard containing multiple actuators. In such instruments, there is normally a different actuator for each of the notes that the instrument can produce. In a piano, for example, the fingers strike keys that in turn actuate sound-producing strings. In other instruments, such as pipe organs, piano accordions, and concertinas, the fingers press actuators that enable air to move through sound-producing passages. A third category of keyboard instruments includes the electric keyboard, in which finger-operated actuators cause different electronic circuits to produce desired notes.

A goal of most instruments is to produce as many notes as practical. To achieve that goal with a keyboard instrument, a large and heavy instrument is usually required. The piano is a prime example. Since by their nature concertinas and piano accordions are portable, the number of actuators and therefore the number of notes that can be produced is intentionally limited. The keyboard of an electric keyboard can occupy as much space as a piano keyboard.

A further characteristic of keyboard instruments is that they require every actuator to be playable by every finger in order to adequately play the instrument. The fingers typically move all over the keyboard during the normal course of playing. A problem that flows from the prior keyboard designs is that a person must memorize the relation between every actuator and its corresponding note independent of the fingers a person might use to play the actuators. There is nothing on the keyboards that assists or guides the placement of the player's fingers. On the contrary, the placement of the player's fingers on the prior keyboards is random. Only in the context of the particular music being played does the actual placement of the fingers acquire any importance.

SUMMARY OF THE INVENTION

In accordance with the present invention, an in-line keyboard is provided that greatly simplifies playing musical instruments. This is accomplished by apparatus that includes perpendicular rows and columns of actuators, each of which causes an instrument to produce a single musical note.

In its simplest form, the in-line keyboard has four columns and two rows of actuators. The eight actuators and the rest of the instrument are designed such that playing the actuators produces one octave of notes. The first row contains the four lowest notes of the octave. The second row, considered to be a higher row, contains the highest notes of the octave. Preferably, the in-line keyboard and instrument are designed such that consecutive actuators in the first row produce notes that ascend according to a musical scale of natural notes. The actuators of the second row correspond to notes that are a continuation of the scale.

For maximum versatility, the in-line keyboard has five columns of actuators. For an in-line keyboard with two rows of actuators, the instrument can play ten notes. Additional octaves are available by adding more rows of actuators.

In a preferred embodiment of the invention with five columns of actuators, the musical note corresponding to the actuator in the first row and last column is the same note as is produced by the actuator in the second row and first column. In that situation, pairs of adjacent actuators in a column correspond to perfect fifths of a scale. For example, notes C and G may be in the same column in adjacent rows. The same applies to notes D and A, E and B, or G and D. Accordingly, playing pairs of adjacent actuators in a column simultaneously produces a harmonious chord.

Any of the rows of actuators can be considered to be a home row of actuators. When the player's five fingers are over the actuators of the home row, the fingers are considered to be in a home position. From the home position, the player moves his fingers only up and down the actuators within the associated columns. All the actuators of a particular column are thus played only by a single finger. For a keyboard having four rows, for example, each finger plays only the four actuators of the column associated with that finger.

Further in accordance with the present invention, actuators that correspond to sharps and flats of a musical scale are incorporated into the in-line keyboard. The sharp and flat actuators are located in columns between the columns of the corresponding natural note actuators. According to one aspect of the invention, the sharp and flat actuators have a different tactile feel then the natural note actuators. The sharp and flat actuators provide guides that aid in keeping the player's fingers in the proper columns at all times.

The method and apparatus of the invention, using actuators arranged in perpendicular columns and rows, thus enables a musical instrument to play a wide range of notes from a compact keyboard. The keyboard is very easy to learn to play, since each finger plays only a few actuators and those actuators are located in a single column.

Other advantages, benefits, and features of the present invention will become apparent to those skilled in the art upon reading the detailed description of the invention.

BRIEF DESCRIPTION OF THE DRAWINGS

FIG. 1 is a schematic view of an in-line keyboard in its basic form.

FIG. 1A is a view similar to FIG. 1, but showing representative musical notes producible by the actuators of FIG. 1.

FIG. 2 is a portion of the notes of a typical musical scale of natural notes.

FIG. 3 is a schematic view of an expanded version of the in-line keyboard of the invention.

FIG. 4 is a top view of a preferred in-line keyboard according to the invention.

FIG. 5 is a front view of FIG. 4.

FIG. 6 is a top view of a modified embodiment of the invention.

FIG. 7 is a front view of FIG. 6.

FIG. 8 is a view of an accordion equipped with an in-line keyboard according to the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIG. 1, a schematic view of an in-line keyboard 11 according to the present invention is illustrated. The in-line keyboard 11 comprises a frame 13 that is part of a musical instrument 14. The in-line keyboard is not limited to use with any particular type of instrument 14. On the contrary, the in-line keyboard is useful with any type of instrument in which individual discrete musical notes are produced by playing respective discrete keys or similar actuators. It is contemplated that pianos, electric keyboards, and piano accordions will especially benefit from the invention.

In the frame 13 are a number of actuators 15. The particular type of actuator 15 is not critical to an understanding of the invention. As illustrated, the actuators are in the form of short cylinders. However, rectangular bars or buttons are also within the scope of the invention.

Similarly, the physical connections of the actuators to the sound-producing members of the instrument 14 are not limited to any particular construction. Rather, the actuators are physically connected to the sound-producing members by mechanisms, typically represented at reference numeral 16, that suit the particular instrument having the in-line keyboard ii. For example, in a piano accordion, the actuators are connected by the mechanisms 16 to the valves 18 that regulate air flow past sound-producing reeds. In a stringed instrument such as a piano, the actuators are connected to the hammers that strike the strings.

My invention is concerned with the placement of the actuators 15 relative to each other and also as related to the notes of a musical scale. Each actuator is connected to the instrument in a manner that produces a single musical note when the actuator is played, such as by the mechanisms 16 and valves 18 of a piano accordion. Playing an actuator and playing a musical note are interchangeably defined as manually pressing an actuator and thereby causing the instrument to produce a sound that corresponds to the actuator.

In its simplest form, the in-line keyboard 11 of the FIG. 1 has eight actuators 15, each corresponding to a different musical note. The actuators are arranged in two rows A, B and four columns 1, 2, 3, 4. Each actuator corresponds to a different note on a musical scale. Further, the actuators are arranged such that the actuator A-1 in row A and column 1 is the lowest note of the scale that can be played by the instrument. Actuator A-2 is the next higher note along the musical scale. Actuators A-3 and A-4 continue along the scale. Actuator B-1 is the next note higher along the scale above note A-4. Actuators B-2, B-3, and B-4 complete the in-line keyboard. If the actuators correspond to all natural notes, the in-line keyboard can play one octave of the notes, with note B-4 being the same note as A-1 but one octave higher. For example, actuator A-1 may correspond to note C of a musical scale. In that case, the other actuators of the in-line keyboard correspond to the notes shown in FIG. 1A. To use the in-line keyboard 11, all the actuators 15 in the first column 1 are played with only one of the person's fingers. If the person plays with his right hand, all the actuators in the first column are played only with the person's first finger of his right hand, and the first finger plays only the actuators in the first column. All the actuators in the second column 2 are played with only the person's second finger, and the second finger plays only the actuators in the second column. Similar relations hold for the person's third and fourth fingers and the actuators in columns 3 and 4. Thus, each of the person's fingers need move only along its associated column of actuators; a finger never has to cross over into another column.

There are several major advantages to the in-line keyboard 11. As one advantage, it is very easy to learn to play. If the actuators in row A are considered to be a home row, notes higher up the musical scale from the notes of the home row are produced merely by playing the actuators in the row B. The design of the in-line keyboard enables a person who is unable to read music to readily play the instrument.

In fact, the in-line keyboard enables a blind person to play a musical instrument. The person can read braille music with one hand and play the instrument with the other hand. The blind person need not be concerned about the original location of his fingers on the in-line keyboard beyond recognizing their locations on the home row.

Another advantage of the in-line keyboard 11 is that adjacent pairs of actuators in each column 1–4 are related by respective perfect fifths along a musical scale of natural notes. Consequently, simultaneously playing two adjacent notes in any column produces a harmonious chord. For example, the chord GC (FIG. 1A) is easily produced by using the first finger to play the C and G actuators simultaneously.

A further benefit of the invention is that it occupies a more compact space, for the same number of actuators, than traditional keyboards. For instance, the length of the in-line keyboard of the invention is but a fraction of the length of a piano, electric keyboard, or piano accordion required for the same number of notes to be produced.

It will be noticed that the arrangement of the actuators, such as those shown in FIG. 1A, form a pattern that is related to the notes as written on a musical scale. Looking also at FIG. 2, the notes along a scale of written music for one octave, starting and ending with note C, are shown. The arrangement of the actuators is such that all the actuators in columns 1 and 3 correspond only to notes with staff lines through them, e.g., notes C and G in column 1. Similarly, all the actuators in columns 2 and 4 correspond only to notes between the staff lines, e.g., notes D and A in column 2. That characteristic of the in-line keyboard further contributes to the ease of learning to play an instrument with the in-line keyboard.

FIG. 3 shows an in-line keyboard 17 having two rows A, B and five columns 1, 2, 3, 4, 5 of actuators 19. Each actuator 19 corresponds to a different natural note producible by the instrument 21. With five columns, a person's thumb is used to play the actuators in the first column 1. The note corresponding to the actuator at row A column 5 is a duplicate of the note corresponding to the actuator in row B column 1. In the example of FIG. 3, the note produced by the actuator A-1 is note C. In addition to being able to produce more than one octave of notes, the in-line keyboard 17 also provides the increased flexibility and versatility associated with different actuators playing the identical note. For example, in the illustrative in-line keyboard 17 of FIG. 3, note G is produced by playing either actuator A-5 or B-1.

FIG. 4 depicts an in-line keyboard 23 having five rows A, B, C, D, E and five columns 1, 2, 3, 4, 5 of actuators 25. Each actuator A-1 to E-5 corresponds to a natural note of a musical scale. A typical correlation of the actuators 25 and the musical notes is shown on the respective actuators. That is, actuator A-1 corresponds to the note G. Other notes are as shown on the actuators. Almost three full octaves of notes are producible using the in-line keyboard 23. Like the in-line keyboards 11 and 17 described in conjunction with FIGS. 1 and 3, respectively, the in-line keyboard 23 has the advantage of fitting a large number of actuators in a compact space. Also, adjacent actuators in each column are related by perfect fifths of a musical scale. It will further be noticed that all the actuators in each column correspond to musical notes that either are on the lines of the staff of written music, or notes that are between the lines of the written music staff. For example, the notes G, D, A, E, B corresponding to the actuators of column 1 all lie between the lines of the musical staff, FIG. 2. The notes A, E, B, F, C corresponding to the actuators of column 2 all lie on the lines of the musical staff.

Further in accordance with the present invention, actuators corresponding to the sharp and flat notes of a musical scale are includable in the in-line keyboard. In FIG. 4, the in-line keyboard 23 includes, in addition to the natural note actuators A-1 to E-5, appropriate sharp and flat actuators 27. Each of the sharp and flat actuators 27 is physically connected to a different sound producing member of an instrument in the same manner as the natural note actuators 25. That is, playing a sharp or flat actuator causes the instrument to produce the corresponding sharp or flat musical note.

The particular placement of the sharp and flat actuators 27 is dependent on the arrangement of the natural note actuators 25. In the in-line keyboard 23, there is an actuator 27A corresponding to the note G sharp. The G sharp actuator is located between the natural notes G and A. Other appropriate sharp and flat notes are as shown. The sharp notes are thus conveniently and intuitively arranged on the in-line keyboard.

It is a feature of the invention that the physical configurations of the natural note actuators 25 are different than the configurations of the sharp and flat note actuators 27. In the preferred embodiment, the natural note actuators 25 are in the form of cylinders. Each cylinder has a top surface 29 that is located at a first distance X above the surface 31 of the in-line keyboard frame 32 or other adjacent portion of the musical instrument 33 when the actuator is at rest, FIG. 5. In contrast to the cylinders of the natural note actuators, the sharp and flat actuators 27 are preferably in the form of parallelepipeds with relatively long and narrow rectangular top surfaces 35. The surfaces 35 are at a distance Y from the instrument surface 31. Preferably, the distance Y for the sharp and flat actuators is greater than the distance X for the natural note actuators.

The sharp and flat actuators 27 perform two important functions. First, of course, when played they cause the instrument to produce the corresponding sharp and flat notes. Second, they serve as guides to aid a person's fingers to remain only in their proper columns. A person almost instinctively realizes a mistake in playing if a finger moves from its proper column over the higher protrusions of the actuators 27 to an adjoining column. In that manner, the in-line keyboard 23 is rendered even easier to play correctly.

As illustrated and described, the natural note actuators 25 are in the form of cylinders. However, other shapes are also possible. For example, the natural note actuators may be parallelepipeds with square top surfaces. The tactile feel of a column of square surfaces with the protrusion X is sufficiently different from the feel of the rectangular surfaces at the protrusion Y to promote the fingers to stay in their proper columns.

FIGS. 6 and 7 depict an in-line keyboard 37 that is particularly useful with a piano accordion 38, FIG. 8. The in-line keyboard 37 replaces the conventional piano-like keys on the treble end of the piano accordion. The presence of the extra actuators 39 and 41 enable two full octaves of notes to be available in a small space. The extra actuator 39 is played with the person's thumb, and the extra actuator 41 is played with the fourth finger.

In summary, the results and advantages of keyboard type musical instruments can now be more fully realized. The in-line keyboard provides both a very easy way to play an instrument as well as the ability to play a wide range of notes from a small space. This desirable result comes from using the perpendicular row and column arrangement of the actuators. The actuators are connected to the instrument in a manner that enables the instrument to produce musical notes corresponding to the actuators played. The actuators correspond to the notes of a musical scale. The actuators are arranged such that playing adjacent actuators produces successive notes along a musical scale. The actuators are further arranged such that each of a player's fingers plays only a single column of actuators. Sharp and flat notes are adjacent the related natural notes. The sharp and flat actuators have a different tactile feel than the natural note actuators, which encourages a player to keep his fingers in the proper columns.

It will also be recognized that in addition to the superior performance of the in-line keyboard, its construction is such as to cost little, if any, more than traditional keyboards. Also, because it is so easy to learn to play, the in-line keyboard is ideal for beginning musicians.

Thus, it is apparent that there has been provided, in accordance with the invention, an in-line keyboard that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A musical keyboard comprising a plurality of first actuators each connected to a different sound producing member of an instrument, all the first actuators being arranged in at least four first columns and in at least two first rows that are perpendicular to the columns, wherein the first actuators correspond to at least one octave of notes of a musical scale, and wherein pairs of adjacent first actuators in a selected column are related by respective perfect fifths of a musical scale, and wherein the first actuators are arranged in at least five columns.

2. The musical keyboard of claim 1 further comprising a plurality of second actuators each connected to a different sound producing number of a musical instrument, the second actuators being arranged in at least four second columns, each second column being between adjacent columns of the first actuators.

3. The musical keyboard of claim 2 wherein the first actuators present a different tactile feel to a person than the second actuators.

4. The musical keyboard of claim 2 wherein the first actuators are shaped as cylinders, and wherein the second actuators are shaped as parallel pipits, such that the first and second actuators present different tactile feels to a person.

5. A musical keyboard comprising a plurality of first actuators each connected to a different sound producing member of an instrument, all the first actuators being arranged in at least four first columns and in at least two first rows that are perpendicular to the columns, wherein the first actuators correspond to at least one octave of notes of a musical scale, and wherein pairs of adjacent first actuators in a selected column are related by respective perfect fifths of a musical scale.

6. A musical instrument comprising:

a. a plurality of sound producing members; and b. a keyboard comprising:

i. a frame; and ii. a plurality of actuators in the frame, each actuator being connected to a corresponding sound producing member, the actuators being arranged in at least two rows and at least four columns that are perpendicular to the rows, each actuator being playable such that the corresponding sound producing member produces a selected musical note, wherein the actuators are arranged in five columns, and wherein:

i. there is a first actuator in a first row that corresponds to a first note of the musical scale; and ii. there is a second actuator in a second row that corresponds to the first note of the musical scale, so that the thumb is usable to play one of the columns of actuators.

7. A musical instrument comprising:

a. a plurality of sound producing members; and b. a keyboard comprising:

i. a frame; and ii. a plurality of actuators in the frame, each actuator being connected to a corresponding sound producing member, the actuators being arranged in at least two rows and at least four columns that are perpendicular to the rows, each actuator being playable such that the corresponding sound producing member produces a selected musical note, wherein pairs of adjacent actuators in each column correspond to respective perfect fifths of a musical scale, so that playing pairs of adjacent actuators of column enables the instrument to produce respective harmonious chords.

8. In a musical instrument having a plurality of first members each capable of producing a different selected musical note, an in-line keyboard for enabling selected members to produce the respective notes comprising a plurality of first actuators each in operative association with a respective first member such that each first actuator corresponds to a different musical note and playing a selected first actuator causes the associated first member to produce the corresponding note, the first actuators being arranged in a frame with at least two first rows of actuators and at least four first columns of actuators that are perpendicular to the first rows, wherein the first actuators are arranged in at least five first columns and at least two rows, wherein each of the first actuators corresponds to a selected natural note of a musical scale, and wherein pairs of adjacent first actuators of each column correspond to respective perfect fifths of a musical scale.

9. The in-line keyboard of claim 8 wherein:

a. the musical instrument has a plurality of second members each capable of producing a different selected sharp musical note; and b. the in-line keyboard further comprises a plurality of second actuators each in operative association with a respective second member of the instrument such that each second actuator corresponds to a different sharp musical note and playing a selected second actuator causes the associated second member to produce the corresponding sharp musical note, the second actuators being arranged in second columns between the first columns and being further arranged in the rows of the first actuators.

10. The in-line keyboard of claim 9 wherein the first actuators present a first tactile feel to a person playing the musical instrument, and wherein the second actuators present a second tactile feel to a person playing the musical instrument.

11. The in-line keyboard of claim 9 wherein:

a. the in-line keyboard further comprises a frame;

b. the first actuators are in the form of cylinders that protrude above the frame; and c. the second actuators are in the form of parallel pipits that project above the frame.

12. The in-line keyboard of claim 11 wherein the second actuators protrude above the frame a greater distance than the first actuators, so that the second actuators guide a person's fingers to stay in respective first columns when playing the instrument.

13. A method of playing musical notes comprising the steps of:

a. providing a plurality of first members each capable of producing a different first musical note;

b. arranging a plurality of first actuators in at least four first columns and two first rows perpendicular to the first columns;

c. connecting each first actuator to a respective first member;

d. playing all the first actuators in a first column only with a first finger, playing all the first actuators in a second column only with a second finger, playing all the first actuators in a third column only with a third finger, and playing all the actuators in a fourth column only with a fourth finger; and e. causing the first members to produce notes corresponding to the respective first actuators that are played.

14. The method of claim 13 wherein:

a. the step of arranging a plurality of first actuators comprises the step of arranging a plurality of first actuators into first, second, third, fourth, and fifth first columns; and b. the step of playing all the first actuators comprises the step of playing all the actuators in the first column only with the thumb, playing all the actuators in the second column only with the first finger, playing all the actuators in the third column only with the second finger, playing all the actuators in the fourth column only with the third finger, and playing all the actuators in the fifth column only with the fourth finger.

15. The method of claim 14 comprising the further steps of:

a. providing a plurality of second members each capable of producing a different second musical note;

b. arranging a plurality of second actuators into first, second, third, and fourth second columns between the first and second, second and third, third and fourth, and fourth and fifth first columns, respectively;

c. connecting each second actuator to a respective second member; and d. causing the second members to produce notes corresponding to the respective second actuators that are played.

16. The method of claim 15 wherein:

a. the step of providing a plurality of first members comprises the step of providing a plurality of first members each capable of producing a different natural note; and b. the step of producing a plurality of second members comprises the step of providing a plurality of second members each capable of producing a different sharp note, so that playing the first actuators causes the first members to produce the respective corresponding natural notes, and playing the second actuators causes the second members to produce the respective corresponding sharp notes.

17. The method of claim 15 wherein:

a. the step of arranging a plurality of first actuators comprises the step of providing the first actuators with a first tactile feel to a person; and b. the step of arranging a plurality of second actuators comprises the step of providing the second actuators with a second tactile feel to a person.

* * * * *